US010074926B2

(12) United States Patent
Rui

(10) Patent No.: US 10,074,926 B2
(45) Date of Patent: Sep. 11, 2018

(54) WATERPROOF CONNECTOR

(71) Applicant: Sumitomo Wiring Systems, Ltd., Yokkaichi, Mie (JP)

(72) Inventor: Hao Rui, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/572,178

(22) PCT Filed: May 23, 2016

(86) PCT No.: PCT/JP2016/065134

§ 371 (c)(1),
(2) Date: Nov. 7, 2017

(87) PCT Pub. No.: WO2016/190269

PCT Pub. Date: Dec. 1, 2016

(65) Prior Publication Data

US 2018/0109028 A1 Apr. 19, 2018

(30) Foreign Application Priority Data

May 26, 2015 (JP) ..... 2015-106505

(51) Int. Cl.
*H01R 13/52* (2006.01)
*H01R 24/20* (2011.01)
*H01R 13/625* (2006.01)

(52) U.S. Cl.
CPC ..... *H01R 13/5202* (2013.01); *H01R 13/5205* (2013.01); *H01R 13/625* (2013.01); *H01R 24/20* (2013.01)

(58) Field of Classification Search
CPC ..... H01R 13/5219; H01R 13/5202
(Continued)

(56) References Cited

U.S. PATENT DOCUMENTS 6,921,292 B2 * 7/2005 Miyazaki ..... H01R 9/032 439/564
7,614,910 B2 * 11/2009 Croteau ..... H01R 13/512 439/559
(Continued)

FOREIGN PATENT DOCUMENTS

JP 2009-94027 4/2009
JP 2013-235761 11/2013
(Continued)

OTHER PUBLICATIONS

International Search Report dated Aug. 2, 2016.

*Primary Examiner* — Neil Abrams
(74) *Attorney, Agent, or Firm* — Gearld E. Hespos; Michael J. Porco; Matthew T. Hespos

(57) ABSTRACT

A waterproof connector (10) includes an annular rubber ring (30) and a housing (20) on which the rubber ring (30) is to be mounted. A trapezoidal rotation stopping rib (34 having two engaging surfaces is provided on a side edge of the rubber ring (30), whereas an accommodation groove (26) into which the rotation stopping rib is to be accommodated is provided in the housing (20). The accommodation groove (26) has a bottom surface (21A). Two facing engaged surfaces (42) are on both sides of the bottom surface (21A) and are configured to press the rotation stopping rib to the bottom surface (21A) by being engaged with the engaging surfaces of the rotation stopping rib.

3 Claims, 6 Drawing Sheets

(58) Field of Classification Search
USPC ..... 439/271
See application file for complete search history.

(56) References Cited

U.S. PATENT DOCUMENTS

| | | | | |
|---|---|---|---|---|
| 7,666,032 | B2 * | 2/2010 | Aoki | H01R 9/032 29/844 |
| 8,177,584 | B2 * | 5/2012 | Matsuoka | H01R 13/5202 439/587 |
| 8,460,015 | B2 * | 6/2013 | Deno | H01R 9/0518 174/78 |
| 8,803,006 | B2 * | 8/2014 | Imahori | H01R 9/032 174/539 |
| 9,071,024 | B2 * | 6/2015 | Shinba | H01R 13/6596 |
| 9,083,107 | B2 * | 7/2015 | Suzuki | H01R 13/5219 |
| 9,124,024 | B2 * | 9/2015 | Itsuki | H01R 13/533 |
| 9,208,922 | B2 * | 12/2015 | Yoshida | H01B 1/02 |
| 9,270,060 | B2 * | 2/2016 | Adachi | H05K 9/0018 |
| 9,293,856 | B2 * | 3/2016 | Shigeta | H01R 13/5202 |
| 9,293,878 | B2 * | 3/2016 | Tashiro | H01R 13/506 |
| 9,318,849 | B2 * | 4/2016 | Kobayashi | H01R 13/5205 |
| 9,343,842 | B2 * | 5/2016 | Tashiro | H01R 13/506 |
| 9,343,941 | B2 * | 5/2016 | Okamoto | H01R 13/5202 |
| 9,478,897 | B2 * | 10/2016 | Kashiwada | H01R 13/5202 |
| 9,692,179 | B2 * | 6/2017 | Jaworek | H01R 13/506 |
| 9,954,304 | B2 * | 4/2018 | Wang | H01R 13/5219 |
| 2009/0098779 | A1 | 4/2009 | Kawamura | |
| 2015/0288090 | A1 | 10/2015 | Shigeta et al. | |
| 2015/0325947 | A1 | 11/2015 | Wang et al. | |
| 2018/0019544 | A1 * | 1/2018 | Ishibashi | H01R 13/6315 |
| 2018/0109028 | A1 * | 4/2018 | Rui | H01R 13/5202 |

FOREIGN PATENT DOCUMENTS

| | | |
|---|---|---|
| JP | 2013-254688 | 12/2013 |
| JP | 2014-107512 | 6/2014 |

* cited by examiner

WATERPROOF CONNECTOR

BACKGROUND

Field of the Invention

This specification relates to a waterproof connector.

Description of the Related Art

Japanese Unexamined Patent Publication No. 2014-107152 discloses a device connector that can fit into a mounting hole in a case of a device. This device connector includes a housing made of synthetic resin. The housing includes a fitting portion that fits into the mounting hole of the device and a mounting portion from which a wire is pulled out. A terminal accommodating portion is accommodated into the fitting portion from the front, and a holder suppresses rearward detachment of this terminal accommodating portion. A rubber ring is mounted on the outer peripheral surface of the fitting portion. However, the device connector described above has no control on the mounting orientation of the rubber ring, and there is no way to know whether or not the rubber ring is mounted at a proper position on the outer peripheral surface of the fitting portion.

FIG. 6 shows a waterproof connector 1 that was thought of to stop the rotation of a rubber ring 2. This waterproof connector 1 includes a housing 3 made of synthetic resin. The housing 3 includes a fitting portion 4, a terminal accommodating portion 5 to be mounted into the fitting portion, and a front retainer 6 for holding the terminal accommodating portion 5 in the fitting portion 4. Two rotation stopping ribs 2A project on a side edge of the rubber ring 2. The rotation stopping ribs 2A stop the rotation of the rubber ring 2 mounted on the outer peripheral surface of the fitting portion 4 by fitting into locking grooves 3A in the housing 3.

However, the rib 2A has a substantially rectangular cross-sectional shape and the locking groove 3A in conformity with the shape of this rib 2A is a rectangular groove composed of a bottom surface and two side surfaces rising at a right angle from the bottom surface. Thus, the ribs 2A may be lifted up from the bottom surfaces of the locking grooves 3A. Ribs 2A that detach from the locking grooves 3A will not stop the rotation of the rubber ring 2.

SUMMARY

This specification relates to a waterproof connector including an annular rubber ring, and a housing on which the rubber ring is to be mounted. A rotation stopping rib is provided on a side edge of the rubber ring and has two engaging surfaces. An accommodation groove is provided in the housing and receives the rotation stopping rib. The accommodation groove is composed of a bottom surface and two engaged surfaces provided on both sides of the bottom surface and configured to press the rotation stopping rib to the bottom surface by being engaged with the engaging surfaces of the rotation stopping rib.

With this configuration, the engagement of the engaging surfaces of the rotation stopping ribs and the engaged surfaces of the accommodation groove press the rubber ring to the bottom surface if a rotating force is applied to the rubber ring. Thus, the rotation stopping rib can continue to fulfil a function of stopping the rotation of the rubber ring without being lifted up from the bottom surface of the accommodation groove.

The housing may include a fitting portion fittable into a mounting hole provided in a case of a device, a terminal accommodating portion to be mounted into the fitting portion and a front retainer configured to hold the terminal accommodating portion in the fitting portion. The bottom surface may be provided on the fitting portion, whereas the engaged surfaces may be provided in the front retainer. According to this configuration, the bottom surface and the engaged surfaces are provided on or in existing constituent components. Thus, the accommodation groove can be configured with the same man-hours as before.

The front retainer may include a receptacle to be fit externally on the fitting portion, and the bottom surface may be a part of an outer peripheral surface of the fitting portion. The engaged surfaces may be facing surfaces that couple an inner peripheral surface and an outer peripheral surface of the receptacle and may face each other in a circumferential direction of the receptacle. According to this configuration, the facing surfaces formed by cutting a part of the receptacle may be the engaged surfaces and an outer peripheral surface of the fitting portion may be the bottom surface. Thus, the accommodation groove can be configured without accompanying a drastic design change.

According to the waterproof connector disclosed by this specification, the rotation stopping rib is less likely to be lifted up from the bottom surface of the accommodating groove.

DETAILED DESCRIPTION

Figure 1:
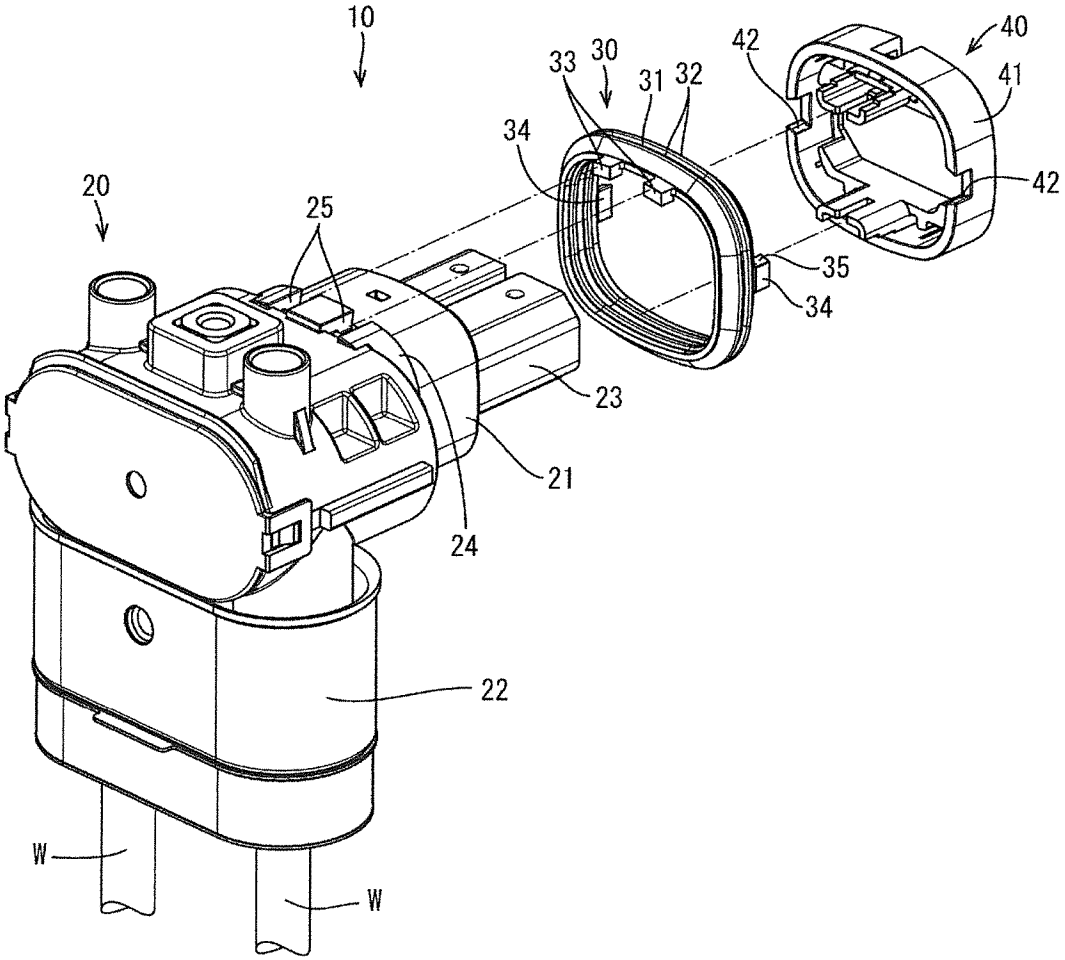
FIG. 1 is an exploded perspective view showing constituent components of a waterproof connector in an embodiment.
Figure 2:
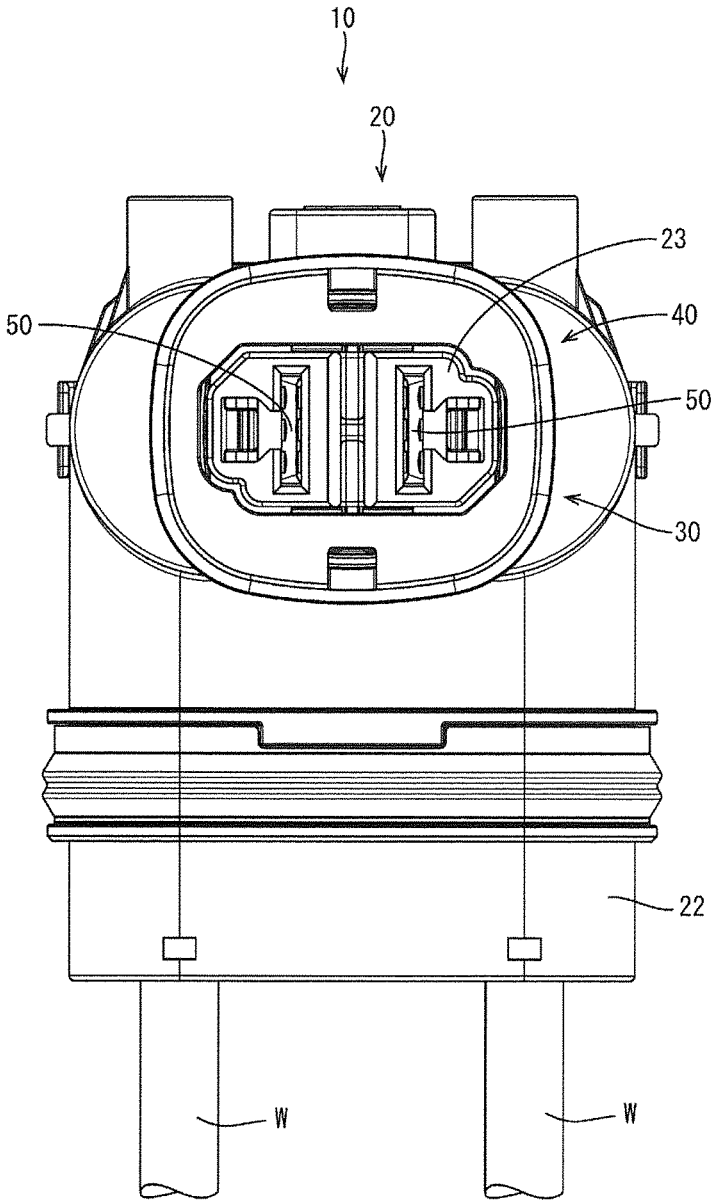
FIG. 2 is a front view of the waterproof connector.

An embodiment is described with reference to FIGS. 1 to 5. A waterproof connector 10 of this embodiment includes a housing 20 made of synthetic resin, a rubber ring 30 and a front retainer 40, as shown in FIG. 1. Further, although not shown, a mounting hole penetrates through a case of a device to which the waterproof connector 10 is to be connected, and the waterproof connector 10 is fittable into this mounting hole.

Figure 5:
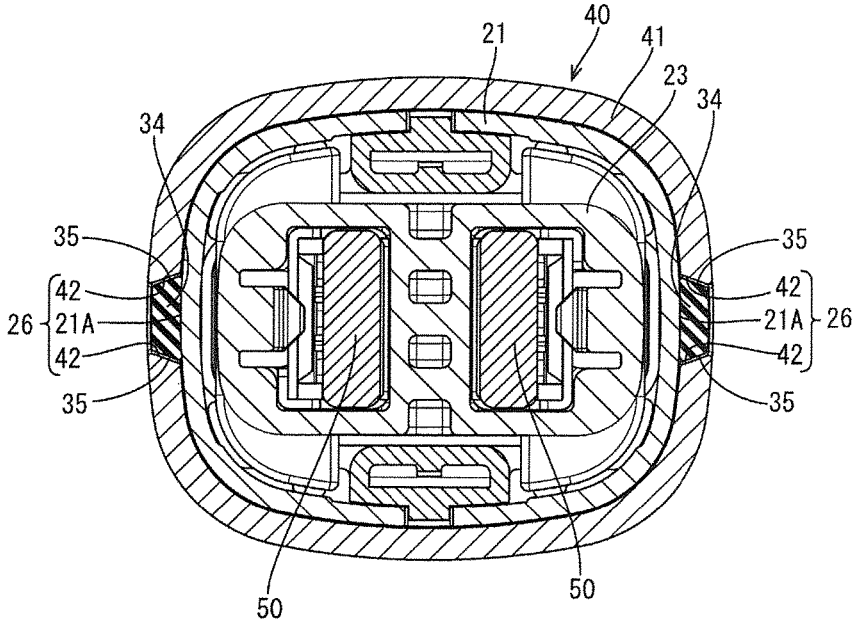
FIG. 5 is a section along A-A in FIG. 4.

The housing 20 includes a fitting portion 21 that is fittable into the mounting hole of the device, a pull-out portion 22 from which wires W are pulled out, and a terminal accommodating portion 23 that is mounted into the fitting portion 21. The front retainer 40 suppresses rearward detachment of this terminal accommodating portion 23. As shown in FIG. 5, terminals 50 are accommodated inside the terminal accommodating portion 23.

As shown in FIG. 1, the rubber ring 30 is mounted on the outer peripheral surface of the fitting portion 21. Further, a butting portion 24 is provided behind the fitting portion 21. The rubber ring 30 mounted on the outer peripheral surface of the fitting portion 21 butts against the butting portion 24 to determine a mount position of the rubber ring 30 in a front-rear direction. Two locking grooves 25 open up and forward on the butting portion 24.

The rubber ring 30 includes an annular body 31 having outer peripheral lips 32 circumferentially provided thereon. Two rectangular ribs 33 project rearward from the rear edge of the body 31 and two trapezoidal ribs 34 project forward from the front edge of the body 31. The rectangular rib 33 is in the form of a column having a substantially rectangular cross-sectional shape and extends in the front-rear direction. The trapezoidal rib 34 is in the form of a column having a substantially trapezoidal cross-sectional shape and extends in the front-rear direction. Further, the rectangular ribs 33 are arranged side by side in a circumferential direction on an upper part of the body 31, and one trapezoidal rib 34 is arranged on each side of the body 31.

Figure 3:
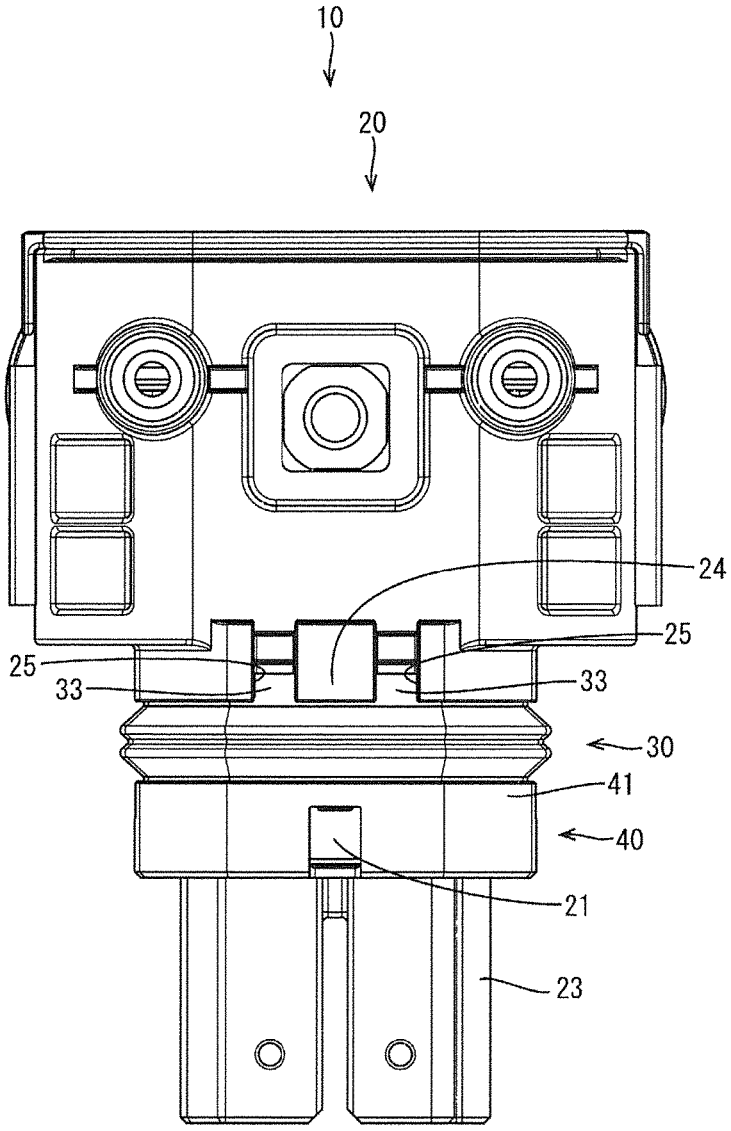
FIG. 3 is a plan view of the waterproof connector.

As shown in FIG. 3, the two rectangular ribs 33 are fit and accommodated into the two locking grooves 25 of the butting portion 24 to determine a mount position of the rubber ring 30 in the circumferential direction. Further, the front retainer 40 includes a receptacle 41 to be fit externally on the outer peripheral surface of the fitting portion 21, and the rear edge of this receptacle 41 suppresses forward detachment of the rubber ring 30. The outer peripheral surfaces of the butting portion 24 and the receptacle 41 are set substantially at the same height and are lower than the outer peripheral lips 32.

Figure 4:
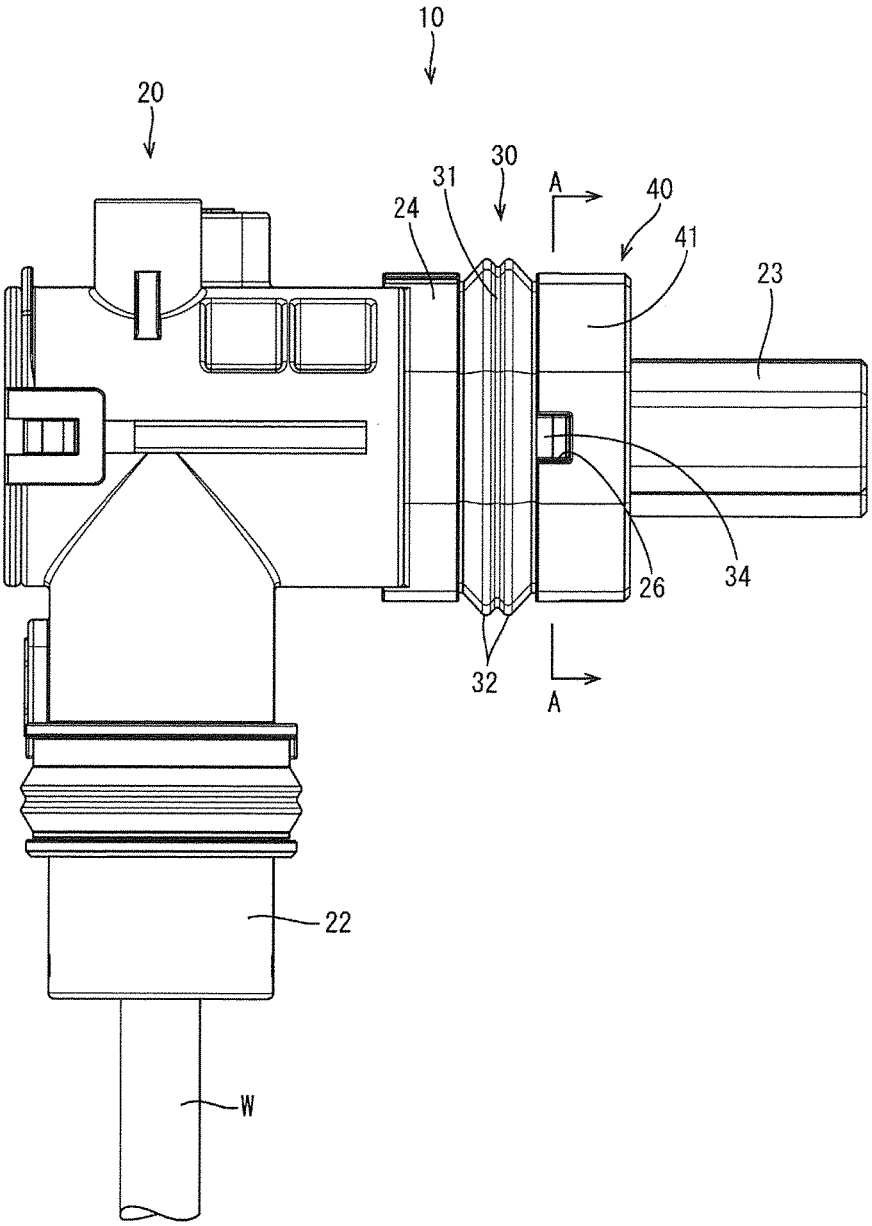
FIG. 4 is a side view of the waterproof connector.

As shown in FIG. 4, two accommodating grooves 26 are provided on both sides of the receptacle 41 in the housing 20 and accommodate the trapezoidal ribs 34. As shown in FIG. 5, this accommodation groove 26 is composed of a bottom surface 21A is a part of the outer peripheral surface of the fitting portion 21, and upper and lower facing surfaces 42 formed by cutting a part of the receptacle 41. The facing surfaces 42 couple the inner and outer peripheral surfaces of the receptacle 41 and face each other in a vertical direction. Further, as shown in FIG. 1, the facing surfaces 42 are provided in a range extending to the rear end opening edge of the receptacle 41. Thus, an accommodation space sandwiched between the facing surfaces 42 is open rearward.

As shown in FIG. 5, the upper facing surface 42 extends obliquely down from the inner peripheral surface toward the outer peripheral surface of the receptacle 41, and the lower facing surface 42 extends obliquely up from the inner peripheral surface toward the outer peripheral surface of the receptacle 41. On the other hand, the trapezoidal rib 34 has upper and lower inclined surfaces 35 to be arranged in proximity to the upper and lower facing surfaces 42. The inclined surface 35 and the facing surface 42 facing this inclined surface 35 are provided at positions capable of contacting each other via a tiny clearance.

Figure 6:
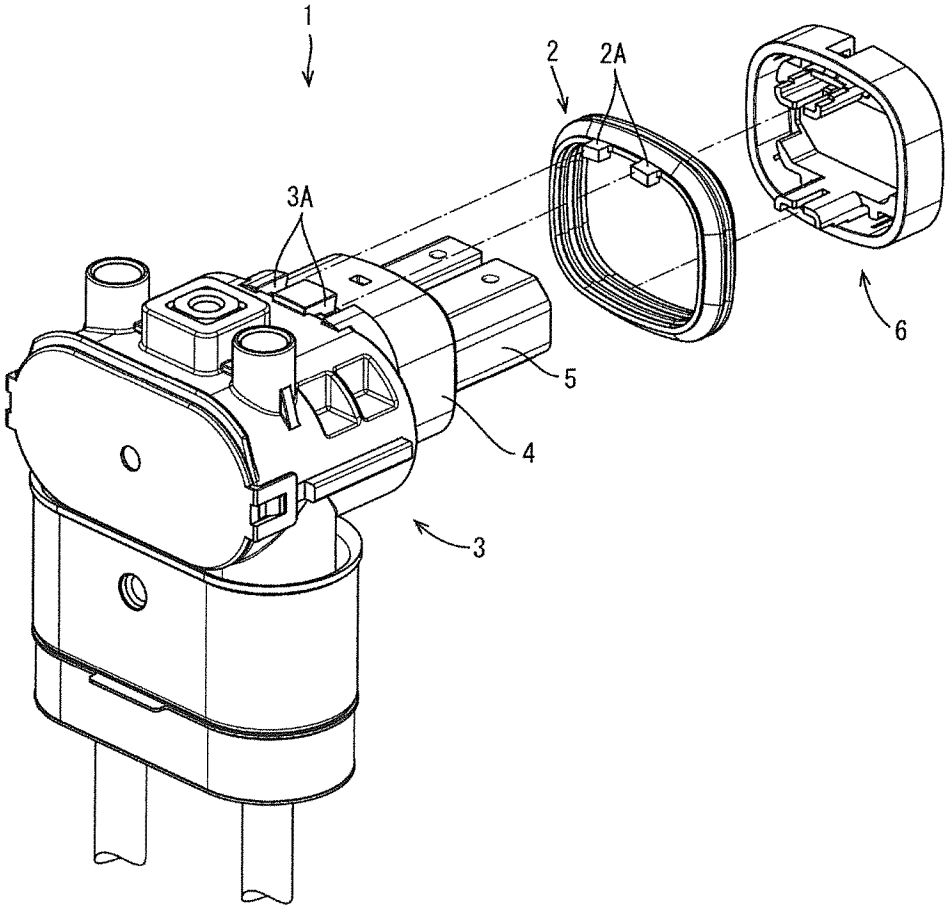
FIG. 6 is an exploded perspective view showing constituent components of a waterproof connector disclosed as a technique pertinent to the present invention.

Thus, if the right trapezoidal rib 35 shown in FIG. 5 is going to move down, the lower inclined surface 35 engages the lower facing surface 42 so that the body 31 is pressed to the bottom surface 21A of the fitting portion 21. At this time, the upper inclined surface 35 cannot be separated from the bottom surface 21A of the fitting portion 21 due to the upper facing surface 42. Thus, the trapezoidal rib 34 cannot detach from the accommodation groove 26. Accordingly, the rotation stop of the rubber ring 30 by the respective trapezoidal ribs 34 is continued, with the result that the rotation stop of the rubber ring also 30 is continued at the respective rectangular ribs 33. As just described, the rotation of the rubber ring 30 is stopped substantially by four ribs 33, 34. Therefore, as a matter of course, a rotation stopping force is drastically larger as compared to the case where the rotation of the rubber ring 2 is stopped by two rotation stopping ribs 2A shown in FIG. 6.

A force in a rotating direction may be applied to the rubber ring 30. However, the rubber ring 30 is pressed to the bottom surfaces 21A by the engagement of engaging surfaces (inclined surfaces 35) of rotation stopping ribs (trapezoidal ribs 34) and engaged surfaces (facing surfaces 42) of the accommodation grooves 26. Thus, the rotation stopping ribs can continue to fulfil a function of stopping the rotation of the rubber ring 30 without being lifted up from the bottom surfaces 21A of the accommodation grooves 26.

The housing 20 may include the fitting portion 21 fittable into the mounting hole provided in the case of the device, the terminal accommodating portion 23 to be mounted into the fitting portion 21, and the front retainer 40 configured to hold the terminal accommodating portion 23 in the fitting portion 21. Additionally, the bottom surfaces 21A may be provided on the fitting portion 21, whereas the engaged surfaces (facing surfaces 42) may be provided in the front retainer 40.

According to this configuration, the bottom surface 21A and the engaged surfaces (facing surfaces 42) are provided respectively on or in the existing constituent components. Thus, the accommodation groove 26 can be configured by the same man-hours as before.

The front retainer 40 may include the receptacle 41 to be fit externally fit on the fitting portion 21, and the bottom surface 21A may be a part of the outer peripheral surface of the fitting portion 21. Additionally, the engaged surfaces may be the facing surfaces 42 may couple the inner and outer peripheral surfaces of the receptacle 41 and may face each other in the circumferential direction of the receptacle 41. According to this configuration, the facing surfaces 42, for example, formed by cutting a part of the receptacle 41 are used as the engaged surfaces and the outer peripheral surface of the fitting portion 21 is used directly as the bottom surface 21A. Thus, the accommodation groove 26 can be configured without accompanying a drastic design change.

The invention is not limited to the above described and illustrated embodiment. For example, the following various modes are also included.

Although the waterproof connector 10 including the front retainer 40 is illustrated in the above embodiment, application to waterproof connector without a front retainer 40 is also possible.

Although the accommodation groove 26 is configured by the housing 20 and the front retainer 40 in the above embodiment, an accommodation groove may be configured only by a housing or may be configured only by a front retainer.

Although the trapezoidal ribs 34 are illustrated as rotation stopping ribs in the above embodiment, the shape of the rotation stopping ribs does may be different and the shape of the accommodation grooves also may be different.

LIST OF REFERENCE SIGNS

10 . . . waterproof connector
20 . . . housing
21 . . . fitting portion
21A . . . bottom surface
23 . . . terminal accommodating portion
26 . . . accommodation groove
30 . . . rubber ring
34 . . . trapezoidal rib (rotation stopping rib)
35 . . . inclined surface
40 . . . front retainer
41 . . . receptacle
42 . . . facing surface (engaged surface)

The invention claimed is:

1. A waterproof connector, comprising:

an annular rubber ring;

a housing including a fitting portion fittable into a mounting hole of a device and having the rubber ring mounted on an outer peripheral surface of the fitting portion; and a front retainer including a receptacle to be fit externally-fit on the outer peripheral surface of the fitting portion and configured to suppress forward detachment of the rubber ring, wherein:

a trapezoidal rib having two inclined surfaces and a substantially trapezoidal cross-sectional shape is provided on a side edge of the rubber ring, whereas an accommodation groove into which the trapezoidal rib is to be accommodated is provided in the housing; and the accommodation groove having a bottom surface defining a part of the outer peripheral surface of the fitting portion and a part of the receptacle and having two facing surfaces provided on both sides of the bottom surface and configured to press the trapezoidal rib to the bottom surface by being engaged with the inclined surfaces of the trapezoidal rib, and the inclined surfaces and the facing surfaces facing the inclined surfaces are provided at positions capable of contacting each other via a tiny clearance.

2. A waterproof connector, comprising:

an annular rubber ring; and a housing on which the rubber ring is to be mounted, wherein:

a rotation stopping rib having a pair of engaging surfaces is provided on a side edge of the rubber ring, and an accommodation groove into which the rotation stopping rib is to be accommodated is provided in the housing;

the accommodation groove having a bottom surface and two engaged surfaces provided on both sides of the bottom surface and configured to press the rotation stopping rib to the bottom surface by engaging the engaging surfaces of the rotation stopping rib;

the housing includes a fitting portion fittable into a mounting hole provided in a case of a device, a terminal accommodating portion to be mounted into the fitting portion and a front retainer configured to hold the terminal accommodating portion in the fitting portion; and the bottom surface is provided on the fitting portion, whereas the pair of engaged surfaces are provided in the front retainer.

3. The waterproof connector of claim 2, wherein the front retainer includes a receptacle to be fit externally on the fitting portion, and the bottom surface is a part of an outer peripheral surface of the fitting portion, whereas the engaged surfaces are facing surfaces that couple an inner peripheral surface and an outer peripheral surface of the receptacle and face each other in a circumferential direction of the receptacle.

* * * * *